US005630524A

United States Patent [19]

Badura

[11] Patent Number: 5,630,524

[45] Date of Patent: May 20, 1997

[54] WASTE CONTAINER CASE AND INNER CONTAINER

[76] Inventor: Manfred Badura, Hermann-Köhl-Str. 18, D-86159 Augsburg, Germany

[21] Appl. No.: 593,866

[22] Filed: Jan. 30, 1996

[30] Foreign Application Priority Data

Feb. 8, 1995 [DE] Germany ..... 195 04 094.5

[51] Int. Cl.[6] ..... B65F 1/06

[52] U.S. Cl. ..... 220/403; 220/910; 150/138

[58] Field of Search ..... 150/138, 144; 220/908, 910, 403, 6

[56] References Cited

U.S. PATENT DOCUMENTS

| | | | |
|---|---|---|---|
| 2,658,544 | 11/1953 | Osaka | 150/138 |
| 2,757,859 | 8/1956 | Holland | 220/910 |
| 3,165,135 | 1/1965 | Mintzes et al. | 150/138 |
| 3,267,980 | 8/1966 | Bird | 150/138 |
| 4,037,634 | 7/1977 | Ricciardi | 150/138 |
| 4,907,634 | 3/1990 | Yoo | 150/138 |

FOREIGN PATENT DOCUMENTS

| | | | |
|---|---|---|---|
| 3445171 | 6/1986 | Germany | 220/910 |

*Primary Examiner*—Stephen J. Castellano
*Attorney, Agent, or Firm*—Jones, Tullar & Cooper, P.C.

[57] ABSTRACT

A waste container case for smokers- and/or chewing gum waste, with a bag-shaped inner container (3) consisting of a flame retardant material and containable in a case (1). The inner container is open in the area of its upper edge and closed along its two side edges and its lower edge, and has at least one transverse closing fold separating, in the receptive state of the waste container, an upper reception part for ash etc. from a lower storage part for the storage of ash etc., the front and the rear of the inner container being capable of separation to enable the ash etc. to fall from the reception part into the storage part. The case for the bag-shaped inner container is reliable, visually attractive, simple, inexpensive and easy to handle. The case has a rear wall and a front wall capable of folding over along the side edge of the inserted inner container, the rear wall having an insertion wall part capable of engagement with the front wall at least along the other side edge of the inner container.

24 Claims, 6 Drawing Sheets

WASTE CONTAINER CASE AND INNER CONTAINER

BACKGROUND OF THE PRESENT INVENTION

The present invention relates to a waste container case and inner container for waste material German Patent 41 36 123 discloses a waste container having a bag- or pouch-shaped case with an open rim for the reception of the bag-shaped inner container. The insertion of the inner container into this case is, however, relatively difficult owing to its transverse closing and bending fold, as the folding of the inner container or tilting makes handling more difficult.

The case for a reception of the bag-shaped inner container in disclosed German Published Application 43 09 232 is designed as a double-walled case comprising two curved walls superimposed on each other and firmly attached to each other below a folding line. From the lower flap created in this way, two walls extend, their cut above the folding line matching the cut of the inner container it is to contain. Guides with guide slots for the insertion of the inner container extending along the side walls between the two walls are fitted with attaching devices which can be released for the insertion of the inner container. These attaching devices, however, are prone to dirt and wear; the arrangement is, moreover, relatively expensive to produce and awkward to handle. Another special problem lies in the fact that heat produced by the residual glow of cigarette ash is insufficiently insulated from the outer surfaces of the case, which feel significantly warm.

SUMMARY OF THE INVENTION

An object of the invention is the present provision of a case for bag-shaped inner containers for the reception of cigarette ash and similar waste, which is as durable as possible, visually attractive, simple, inexpensive and easy to handle.

According to the present invention, the inner container is very simply inserted into the case by opening up the case, placing the inner container into the pocket formed between the rear wall of the case and the insertion wall part and finally snapping the case shut. Since the case is normally transported folded about transverse folds of the inner container, there is no need for any devices for locking the inner container in position. Since the case completely encloses the inner container, adequate heat and odor insulation is nevertheless ensured. If the front wall of the case is inserted into the insertion wall part as well, the case is closed even better and tighter even when folded open.

The side of the case where the upper reception part covers the lower storage part in the closed state is provided with adequate heat insulation. The present invention ensures that the storage area on the other side of the case is now also adequately insulated by the insertion wall part and the front wall placed therein.

The case is preferably equipped with folding lines congruent with transverse folds of the inner container to be placed into the case to facilitate the shutting of the case and thus the odor and heat insulating containment of the inner container in the case. The case is usefully provided with a closure in the form of a latching button in order to prevent inadvertent opening and the resulting odor nuisance.

The edging of the insertion tab preferably lies diagonal across the rear wall to facilitate the stable insertion of inner container and ensure good heat and odor insulation. For optimum heat and odor insulation, it is especially advantageous to provide an additional pocket-shaped insert which at least partially encloses the bag-shaped inner container at least in the storage area, which would, moreover, permit the inner container to be made substantially thinner and thus significantly reduce the amount of waste.

In order to compensate for the very small amount of emerging odor, the interior of the case is usefully coated with a fragrance having a strong, fine smell. The coating of the interior is advantageous in that the fragrance is preserved relatively longer than if the exterior is coated.

In another, also very advantageous embodiment, at least one tab formed on the insertion wall can be engaged with a corresponding slot in the front wall of the case. This facilitates a very reliable and functional closure of the case and creates a very good visual impression. At least one of the tabs is preferably provided with one or more engagement recesses to ensure excellent security in the closed state. The attractive impression is reinforced by the approximate congruence of the tab with the rear wall at least in the storage area.

If the unit is used as a table top ash tray, it may happen that the upper part of the case, which encloses the reception part of the bag-shaped inner container, remains only for a short time or not at all in a position angled in the area of the folding line associated with the transverse closing fold of the inner container, which stands in the way of the universal application of the waste container. To avoid this, the insertion wall part is preferably provided with a retaining element for stabilizing the case in a position angled in the area of the folding line associated with the transverse closing fold.

In this way, the upper part of the case, which encloses the reception part of the bag-shaped container, reliably remains in a position angled in the area of the folding line associated with the transverse closing fold of the inner container. This being so, the waste container can reliably be used as a table top ash tray. Since the upper part with the enclosed reception part of the inner container, which contains ash, cigarette stubs etc., does not tip over, the table on which the waste container stands is not contaminated by ash residue.

It is further advantageous if the retaining element is provided with a tongue extending from its edge towards the opening of the inner container and encompassing the rear of the case in the area of the reception part in the angled position of the upper part of the case. This design provides, by simple means, a reliable device supporting the rear wall of the case in a position angled upwards from the table. The retaining element, in particular the tongue, is usefully made of a flexible material or provided with a flexible insert, thus being cost-effective in production and effective in use.

The insertion wall part is preferably provided with an integral tab extending beyond the folding line associated with the transverse closing fold and having a tongue extending backwards in the direction of the opening of the inner container in the case, this being simple in design.

The tongue is usefully formed in the center of the insertion wall part, thus providing very good support for the upper part of the case enclosing the reception part of the inner container.

The insertion wall part with the retaining element preferably extends at least approximately over the width of the front wall, thus holding the retaining element on the insertion wall part and securing it against torsion. This arrangement further permits the central mounting of a retainer on the insertion wall part.

To this retainer, a receptacle for a cigarette packet and/or a cigarette lighter can usefully be removably attached.

In a waste container case according to the present invention, the front wall part of which has a lockable flap and the inner container of which is foldable above a transverse fold, it is also useful to provide the flap with a folding tongue extending backwards from the folding line associated with the transverse closing fold of the inner container in the closed position of the case and overlapping the opening of the inner container. The folding tongue and the flap further stiffen the rear wall of the case in its angled position, so that the upper part of the case enclosing the reception part of the inner container cannot give way and bend back over the retaining element to adopt an inclined to approximately level position. The folding tongue overlapping the opening of the inner container moreover ensures that the closing area of the inner container on the side of the opening is folded over together with the tongue, enabling a locking element such as a latching button on the flap to engage a counterpart on the insertion wall part without the closing area of the inner container on the side of the opening getting between the latching button and its counterpart.

Of special advantage is the provision of the rear wall of the case with a retaining element to stabilize the reception part in its angled position relative to the storage part; this facilitates the use of the waste container as a table top ash tray in a simple and cost-effective manner.

BRIEF DESCRIPTION OF THE DRAWINGS

Further characteristics and advantages of the present invention are disclosed in the description of the embodiments thereof with reference to the drawing, of which

FIG. 6 is a top view of a case the front wall of which is vertically folded relative to the rear wall of the case from the plane of the drawing, FIG. 7 is a top view of a waste container case which is opened up, folded open case and having an inner container located therein, in, FIG. 8 shows the case of FIGS. 6 and 7 in its opened up, folded over state, FIG. 9 is a side section of the case in the state illustrated in FIG. 8.

DESCRIPTION OF THE PREFERRED EMBODIMENTS

Figure 2:
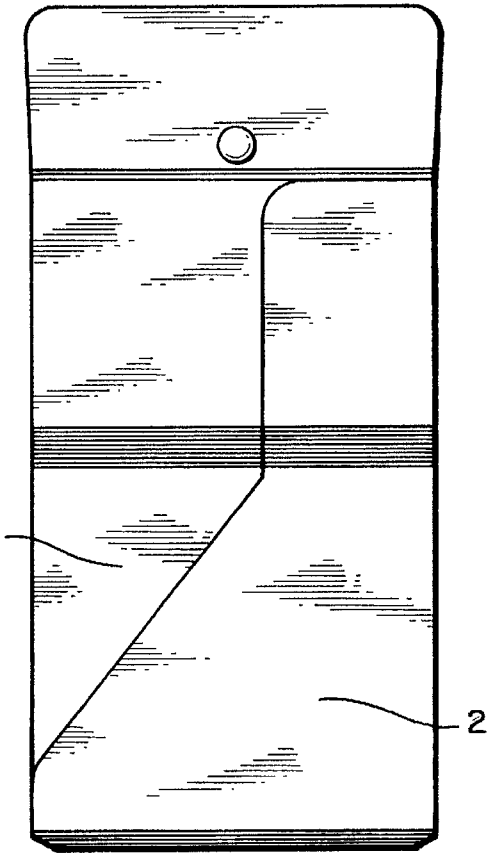
FIG. 2 shows the case of FIG. 1 in its closed state.
Figure 1:
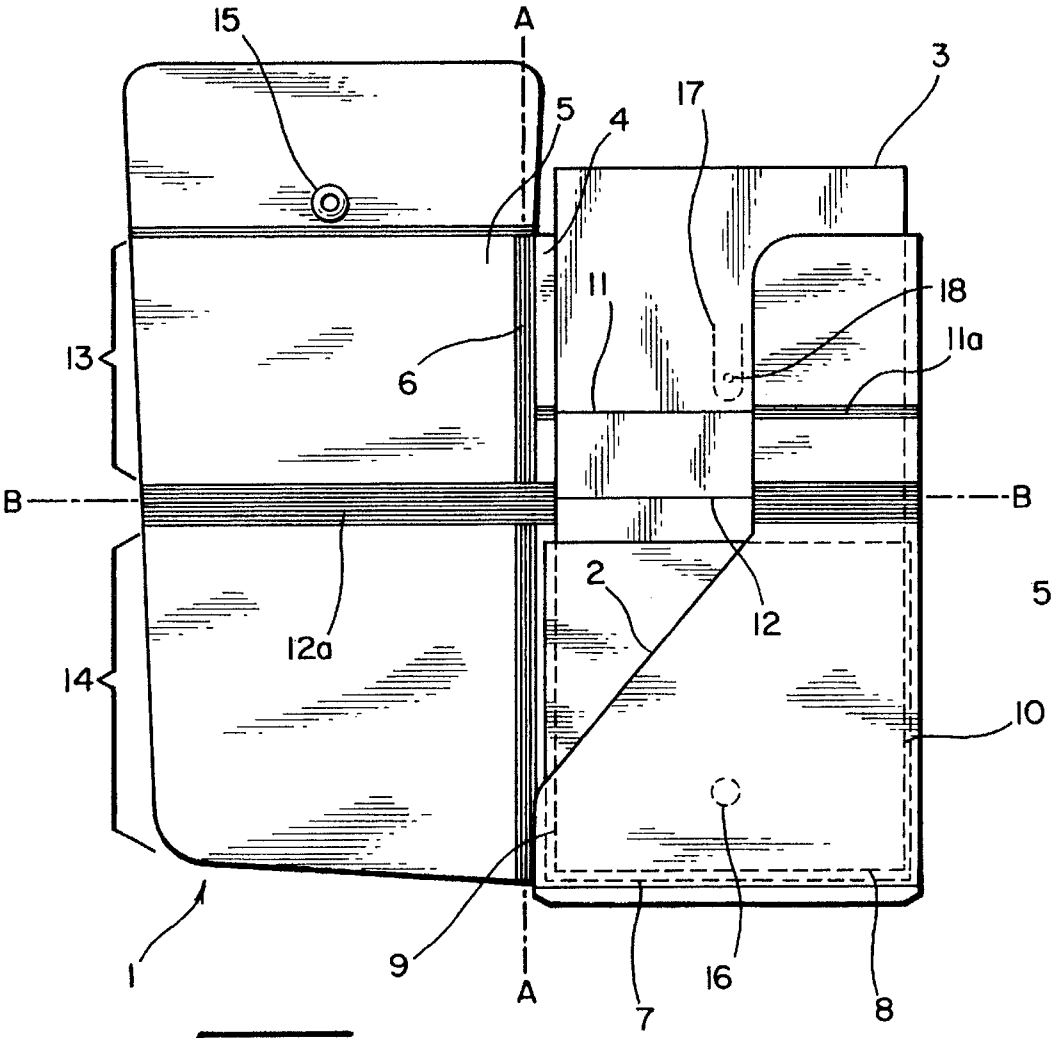
FIG. 1 is a top view of a first embodiment of a folded open and opened up case.

The case 1 illustrated in FIG. 1 has an insertion wall part 2, into which a bag-shaped inner container 3 can be placed in a very simple manner. The bag-shaped inner container 3 will usefully have slightly shorter external dimensions than the rear wall 4 of the case 1. The front wall 5 of the case 1 can be folded about the axis A—A, i.e. a side edge 9 of the inner container 3, to cover the rear wall 4, so that the bag-shaped inner container 3 is enclosed by the case 1 according to FIG. 2 on all sides with the exception of the top opening side. The folding down of the front wall 5 of the case 1 is facilitated by material weakening along the longitudinal folding line 6 shown in FIG. 1, which is approximately 2 mm wide in the present case and approximately congruent with a side edge 9 of the inserted inner container 3. The closed state of the case 1 is generally fixed by pushing the front wall 5 into the insertion wall part 2. To prevent damage to the case 1 by corners of the inner container 3 during prolonged use and to improve heat and odor insulation, a pocket insert 7 made of cardboard, plastic or a similar material may be incorporated in the case 1, the insert being closed towards the lower edge 8 and or the side edge 10 of the inner container 3 and open towards the upper edge and at least one side edge 9 of the inner container 3; this pocket insert considerably boosts the heat and odor insulation of the case 1, which is of particular importance in the storage part 14 of the inner container 3.

It can additionally be coated with a fine fragrance. Instead of the pocket insert 7, a piece of fleece can be incorporated, for instance by bonding at least to the rear wall 4 and preferably to the front and rear wall, to form two layers in the case 1.

To use the waste container case, the front and rear walls of the case are separated when opening the inner container 3 in the area above a transverse fold 12 or 122, and the ash is introduced into the upper reception part 13 of the inner container 3. Opening the inner container 3 and the case 1 at the lower transverse fold 12 permits the hand-held use of the case 1, while opening the inner container 3 at the upper transverse fold 11 and folding the inner container and the case over at the upper transverse fold 11 permits use as a table top ash tray.

The opening of the inner container 3 can be made significantly easier by materially weakened folding lines 11*a*, 12*a* of the case 1 congruent with the transverse folds 11, 12. For the additional security of the waste container in its receptive state, i.e. open position, the provision of a retaining device on the rear wall 4 of the case is of great advantage. In the present case, this retaining device is designed as a locating plate 17 stamped out on the rear wall, which is here provided with a fastening device in the form of a recess 18 engageable with the counterpart 16. After use, the still folded container is folded about the axis B—B, and the case is closed by pushing a latching button 15 into the counterpart 16. Instead of a latching button 15 and a correspondingly designed counterpart 16, a Velcro fastener could, for instance, be used. The case 1 can further be provided with a slot for a wall of a folding match book. The sides of the case 1 forming the inside in the folded state can be coated with a fine fragrance.

Figure 3:
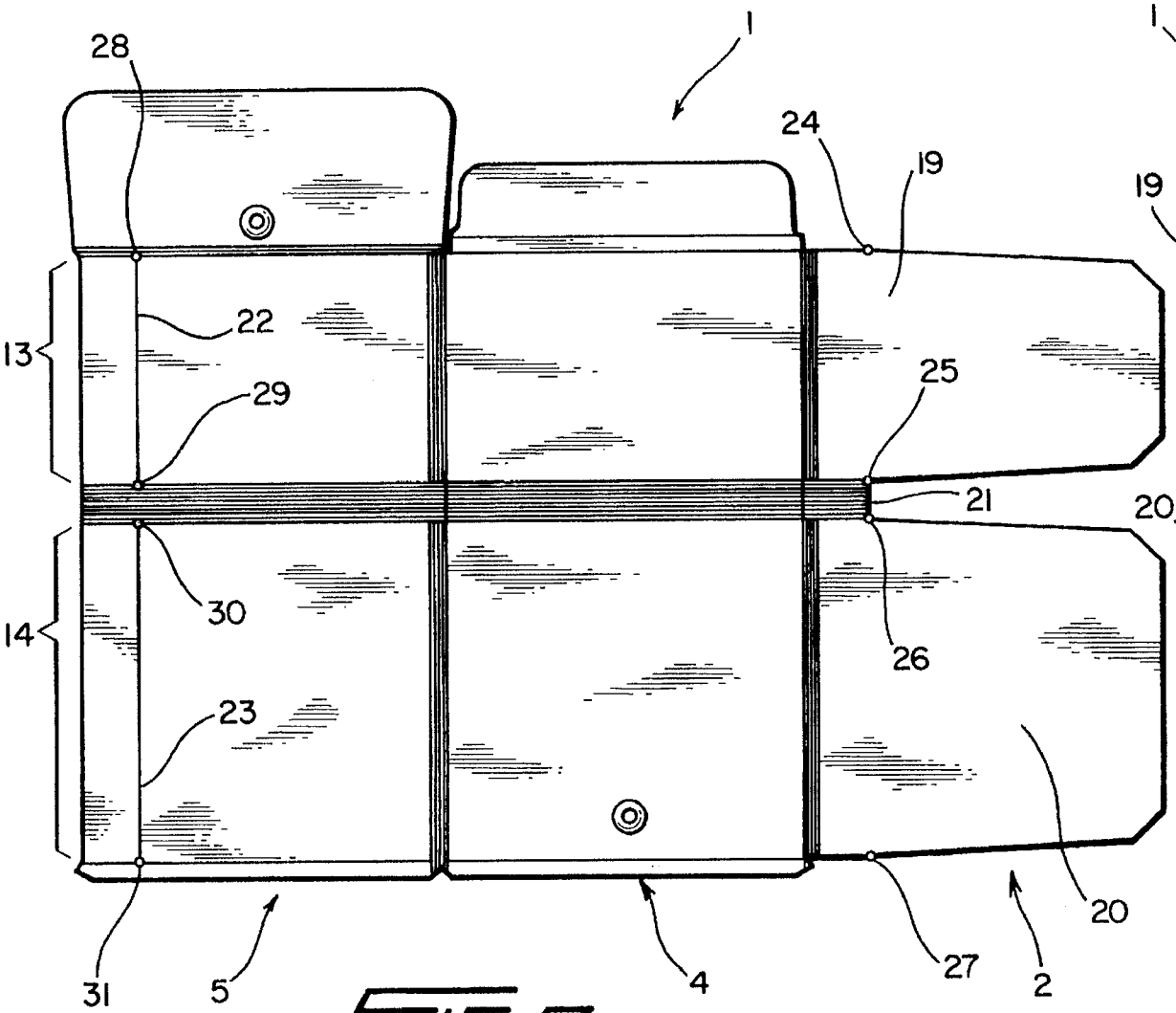
FIG. 3 is a top view of a second embodiment of a folded open and opened up case.

FIG. 3 illustrates another embodiment of a case 1 for a waste container according to the present invention.

The insertion wall part 2 of this case 1 has two closing flaps 19, 20, which are here connected by a web 21 for the purpose of stability and appearance. The closing flaps 19, 20 cover almost the entire surface of the rear wall of the storage part 14 of the case 1, offering very good heat insulation for the cigarette ash against the outside, especially by the approximately congruent covering of the bottom or top surface of the rear wall 4 by the insertion wall part, in this case the closing flap 20. To close the case 1 round the inner container 3, the flaps 19 and 20 are inserted into slots 22, 23 extending parallel to the side edges 9, 10 in the front wall 5. To secure the flaps in the engaged position, engagement recesses 24–31 are provided on the side edges of the closing flaps 19, 20 and the slots 22, 23. In the folded state, the engagement recesses 24, 25 of the top closing flap 19 engage the engagement recesses 28, 29 of the upper slot, while the engagement recesses 26, 27 of the lower closing flap 20 engage the engagement recesses 30, 31 of the lower slot 23. The insertion wall part 3 can alternatively be provided with only one closing flap, for instance at the level of the storage part 14. As a result of the very deep engagement, the case 1 is reliably closed. The engagement recesses 24–31 may also have a diamond or slot shape or another number.

Figure 4:
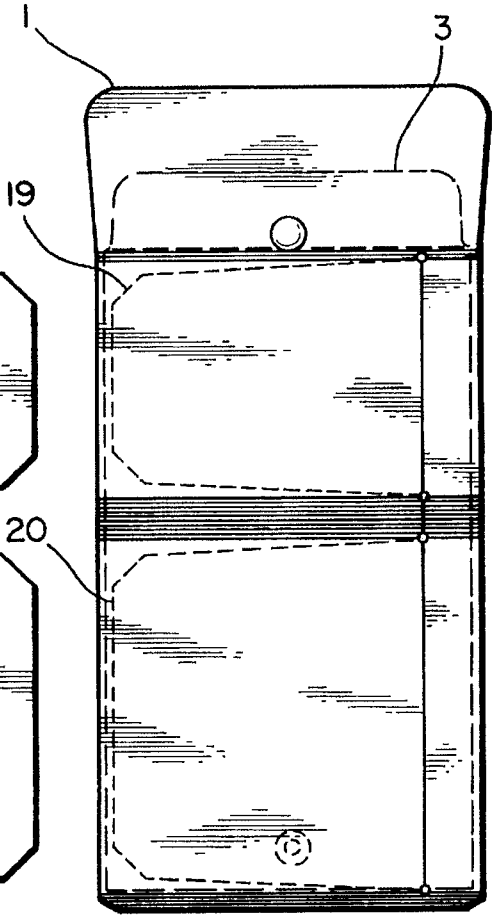
FIG. 4 shows the case of FIG. 3 in its closed state.

As FIG. 4 reveals, the case 1 according to FIG. 3 can look very attractive in the folded state. For added stability, at least one wire extending parallel to a side edge 5, 10 of the case 1 can be incorporated into the case. The case 1 of the waste container according to the present invention may, for instance, be fitted to a car by means of Velcro strips or suction pads or to a belt by means of a sling etc.

Figure 5:
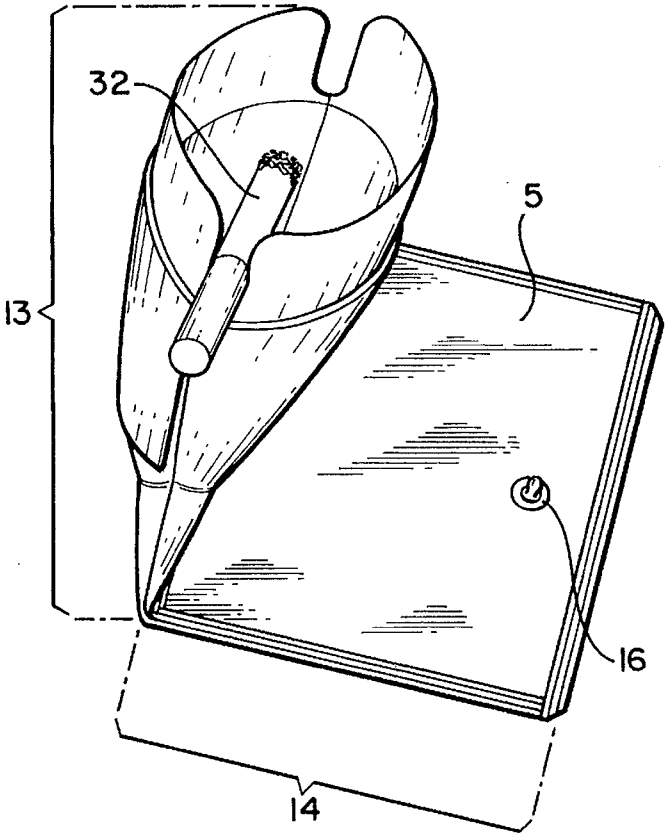
FIG. 5 shows a waste container case with an inner container contained therein with opened reception part.

FIG. 5 illustrates the use of the waste container with a cigarette 32 deposited in a recess of the inner container 3, its ash falling into the reception part 13.

Several design variations of the present invention deviating from the illustrated embodiments are feasible. The insertion wall part 2 can, for instance, differ from the illustrated examples and be provided with any subdivisions or engagement elements.

A further case according to the present invention is described below with reference to FIGS. 7–12; if used as a table top ash tray, this case avoids the risk of the open waste container folding or toppling over.

Figure 10:
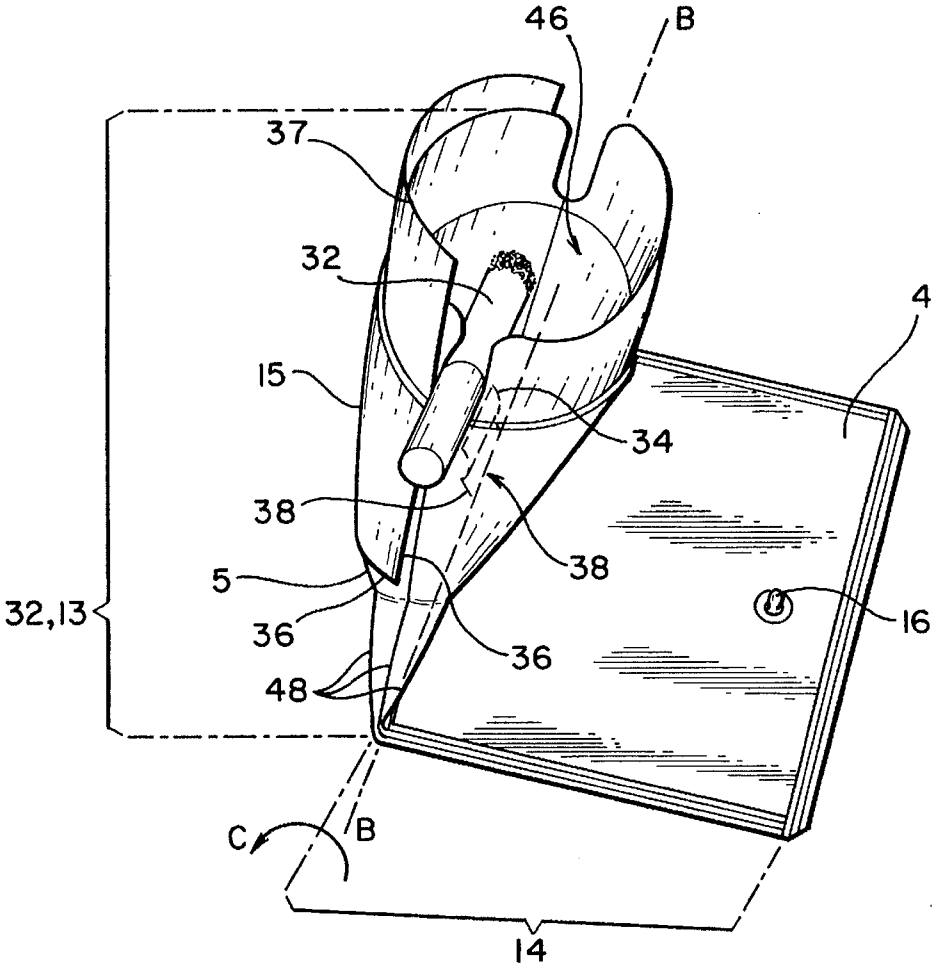
FIG. 10 shows a waste container used as a table top ash tray with an upper case part angled about a folding line associated with a transverse fold of the inner container.
Figures 6, 7, 8, 9:
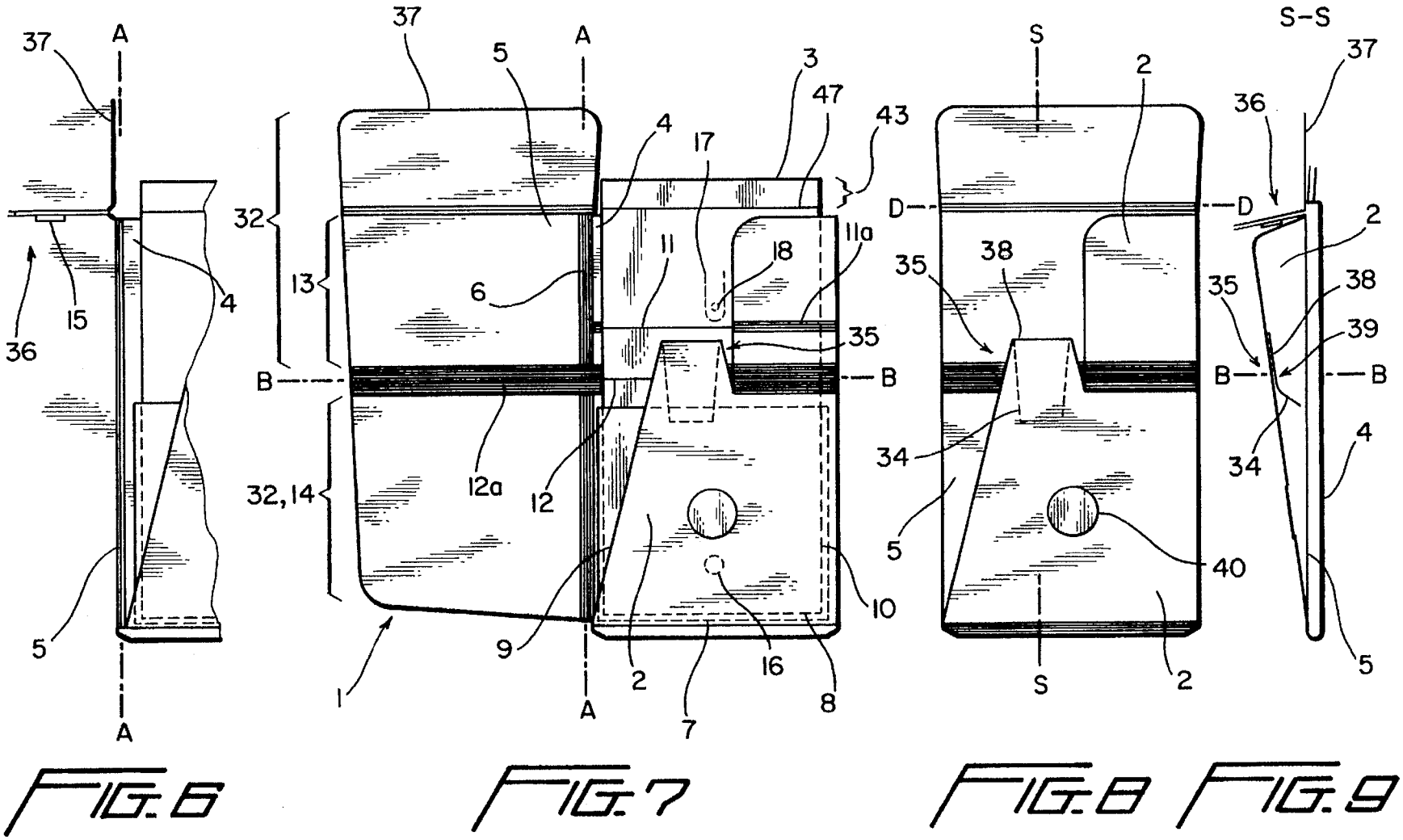

The waste container for smokers and/or chewing gum waste shown in FIG. 7 also comprises a case 1 and an inner container 3 enclosed by a pocket insert 7. The case 1 comprises a rear wall 4, an insertion wall part 2 fixed thereto in the area of a lower edge 8 and a side edge 10, and a front wall 5, which can be folded about the axis A—A and inserted under the insertion wall part 2. For transport purposes, the waste container can, when the front wall 5 has been folded about the axis A—A and inserted under the insertion wall part 2, be folded up about the axis B—B. When folded about the axis B—B, it can be held in the hand to be used as a hand-held ash tray after separating the front and rear walls of the inner container 3 at least in the area of the reception part 13 to form an opening 46. After use, front and rear are separated in the area of the transverse fold 12. The ash now falls through the upper reception part 13 of the fireproof inner container 3 into its storage part 14. When used as a table top ash tray as illustrated in FIG. 10, the reception part 13 of the inner container 3, which is covered by the upper part 32 of the case, is folded about the axis B—B in the area of the folding line **12*a* associated with the transverse closing fold 12 of the inner container to project upwards at an angle of approximately 90° from the storage area and, while the front and the rear of the inner container are separated, stabilized by kinking in the area of kinking lines 48 in the inner container 3 and matching bending lines in the case 1. According to the present invention, the upper part 32 of the case and the reception part of the inner container 3 covered thereby are further stabilized by the tongue 34 of a retaining element 35. The tongue 34 lies flat against the outside of the front wall 5 of the case, preventing the upper part 32 of the case from tilting in the direction of arrow C about the axis B—B into a level or inclined position. Further stabilisation is, as shown in perspective in FIG. 10, provided by a flap 36 with a folding tongue 37 on the front wall 5 of the case, which reinforces the front wall 5 in the upper part 32 of the case, thereby preventing its buckling against the curvature shown in FIG. 10 and its bending backwards into an approximately inclined position over the tongue 34 of the retaining element 35**.

The construction of the retaining element 35 and the folding tongue 37 is explained by the description of FIGS. 6 to 9.

As illustrated by FIGS. 7 and 8, the retaining element 35 is an integral part of the insertion wall part 2. In the examples shown in FIGS. 7 and 8, it extends upwards beyond the level of the folding line **12*a*** and the folding axis B—B.

Figure 11:
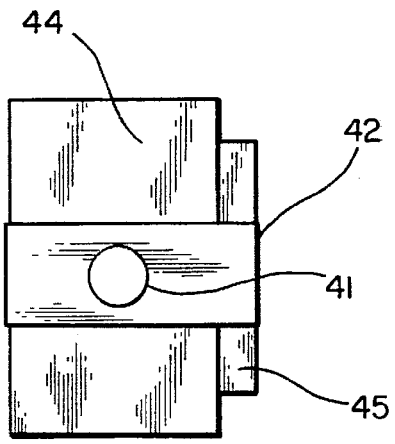
FIG. 11 is a top view of a receptacle for a cigarette packet or cigarette lighter attachable to a bracket on the insertion wall part by means of a mating bracket.
Figure 12:
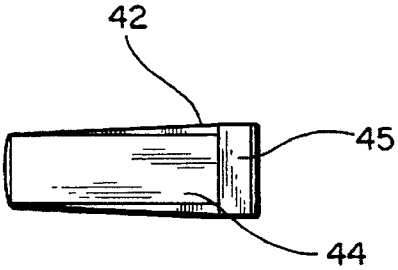
FIG. 12 is a side view of the receptacle of FIG. 11, containing a cigarette lighter and a cigarette packet.
Figure 14:
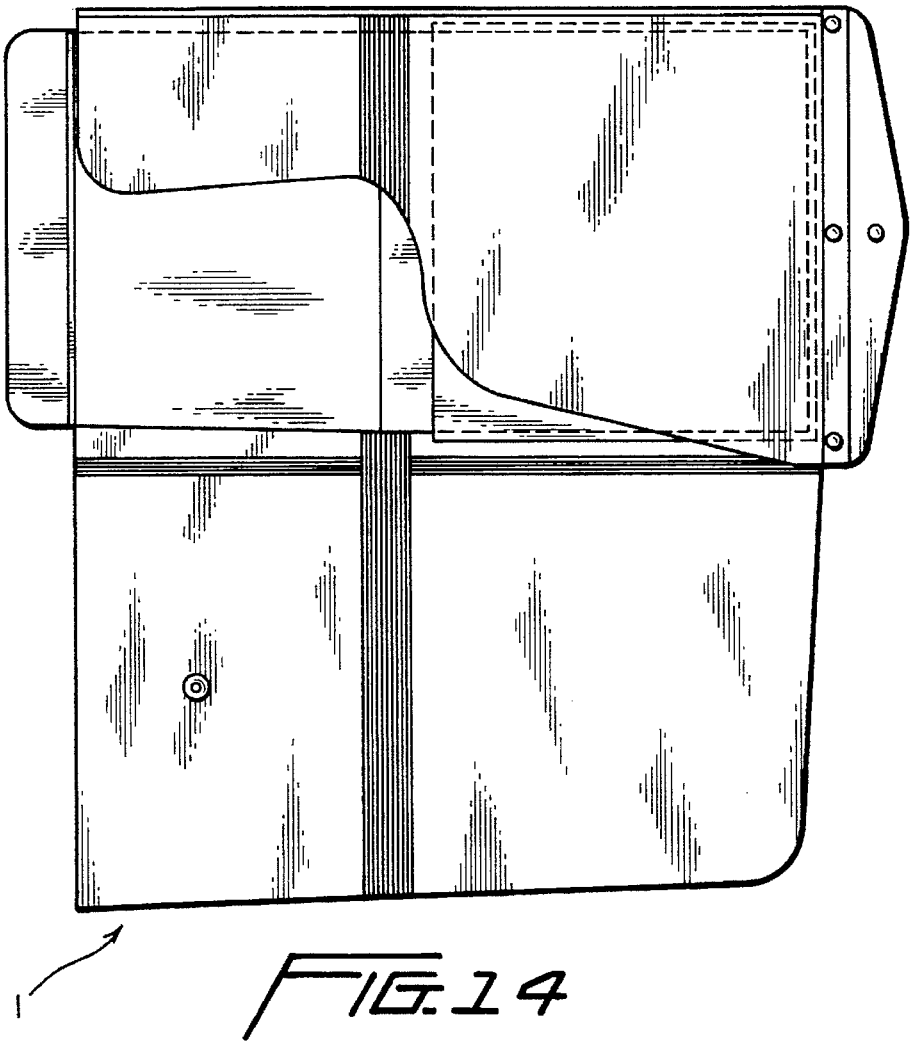
FIG. 14 is a top view of the front of the case illustrated in FIG. 13 with opened up insertion wall part.

As illustrated in FIG. 9, the retaining element 35 is designed as a tab 38 extending beyond the folding line **12*a* and the folding axis B—B. From the tab 38 in FIG. 9, a tongue 34 extends downwards. As illustrated in FIG. 10, this tongue 34 can, here in the approximately vertical position of the upper part 32 of the case, be brought behind the front wall 5 of the case 1, holding the upper part of the case approximately square in relation to its lower part. To achieve this, at least the tongue 34 shown in FIG. 9 is made of a flexible material. In the simplest case it can, like the insertion wall part 2, be made of a flexible material such as imitation leather etc. As in the present example, it can be integral with the insertion wall part 2, or it may be sewn or otherwise attached thereto. In contrast to the illustrated example, the tongue 34 can be provided with integral or mounted flexible elements, such as metallic elements, in particular steel springs, steel platelets etc. In the present case, the retaining element 35 is integral with the insertion wall part 2, the tongue 34 and the tab 38 being formed by folding over and attachment by means of a seam 39. As illustrated in FIGS. 7 and 8, the tongue 34 of the retaining element 35 is located approximately in the center of the insertion wall part 2. The insertion wall part 2 extends approximately over the width of the rear wall 4 to ensure a good hold of the retaining element 35, in particular to prevent its bending or folding over. This makes room for a retainer 40 in the area below the retaining element 35 on the insertion wall part 2, to which, for instance, a receptacle 42 for a cigarette packet 44 and a cigarette lighter 45 as shown in FIGS. 11, 12 can be removably fitted. In FIGS. 11, 12, the receptacle 42 encompasses a cigarette packet 44 and a cigarette lighter 45. It is here designed as a closed ring. The receptacle 42 can, for instance, be made of plastic or leather. For attachment to the case, the receptacle illustrated in FIG. 12 is provided with a counterpart 41 for the retainer 40. In the present case, the retainer 40 and its counterpart 41 consist of Velcro elements. The receptacle 42 may alternatively be fixed to the case 1 by means of a clip or by extending the tab of the retaining element to form a ring closable by a Velcro fastener. The receptacle 42 may also be rotatably fixed to the case, for instance by means of a rotatable latching button. The case may, as shown in FIG. 14, be provided with an eye for a ring such as is used for bunches of keys. As an alternative, the receptacle 42** may be provided with claws gripping the sides of the cigarette lighter or the cigarette packet.

As mentioned previously, further reinforcement for the upper part of the case in its vertical position relative to the lower part is provided by a flap 36 with a folding tongue 37 located on the front wall 5. The folding tongue 37 as shown in FIG. 6 is sewn to the flap 36, which is integral with the front wall 5. This arrangement offers the particular advantage that the folding tongue 37, when the container is folded up about the axis B—B after use, has to be folded about the axis D—D together with the also foldable closing area 43 of the inner container 3, so that the inner container 3 reliably seals in any odors and the latching button 15 can engage its counterpart 16 without the closing area 43 of the inner container getting in the way. FIGS. 13–16 show another case suitable for use as a table top ash tray, with a retaining element 35 by means of which the reception part 13 is held at an angle and thus open relative to the storage part 14, which may, for instance, lie on a table.

The retaining element 35 is here designed as a tab 49 with an insertion element 50 at its end. On the side opposite the insertion element 50, the tab-shaped retaining element 35 is fixed to the case, being located on its rear wall in the present example by a line of adhesive 52, rivets etc.

FIG. 14 shows the front of the case with the insertion wall part folded open.

Figure 15:
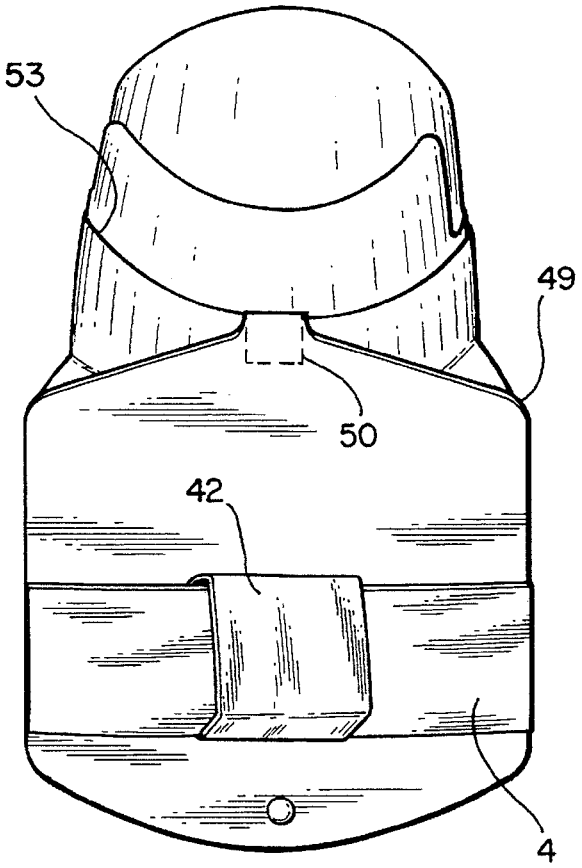
FIG. 15 is a perspective view of an opened up case stabilized by a retaining element according to FIGS. 13, 14.

FIG. 15 is a perspective view of this case when used as a table top ash tray in its open position. The insertion element 50 on the tab 49 is inserted behind the upper edge 53 of the rear wall 4. In this way, the reception part 13 of the waste container case is reliably held in an inclined or vertical position relative to the storage part 14. This case, too, may be provided with a receptacle 42 for a cigarette lighter.

Figure 16:
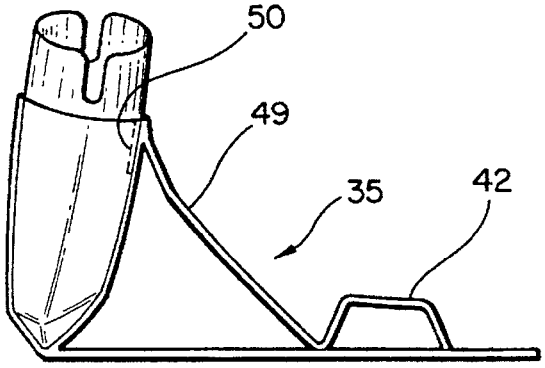
FIG. 16 is a side view of the case illustrated in FIG. 15.
Figure 13:
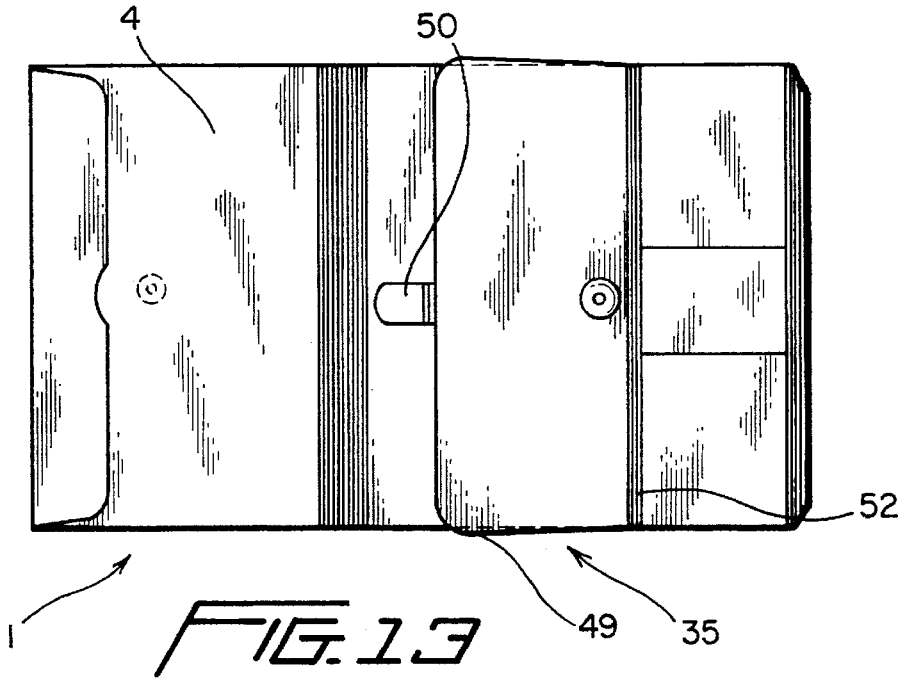
FIG. 13 is a top view of another case according to the present invention with a tab-shaped retaining element located on its rear wall.

FIG. 16 is a side view of the arrangement according to FIG. 15.

To three sides of the front or rear wall, a foil lying parallel to the wall concerned may be attached to form a pocket for tickets, cash etc.

What is claimed is:

1. A waste container case and inner container for waste material, comprising:

an inner container made of a flame retardant material, said inner container having a front and rear joined together along two side edges and a bottom edge and open at its top edge, at least one transverse closing fold separating an upper reception part from a lower storage part, with the front and rear being capable of separation to enable waste material to fall from the reception part to the lower storage part; and a case for containing said inner container, said case having a front wall, a rear wall foldable along a side edge of said inner container, an insertion wall part provided on the rear wall at least along the other side edge of said inner container, said insertion wall part being engageable with the front wall, and fold lines congruent with said at least one transverse closing fold of said inner container.

2. The waste container case and inner container according to claim 1, wherein a receptacle for a cigarette lighter and a cigarette packet are mounted on the rear wall.

3. The waste container case and inner container according to claim 1 further comprising: a closure in the form of a latching button.

4. The waste container case and inner container according to claim 1, wherein the edge of the insertion wall part extends diagonally across the rear wall of the case.

5. The waste container case and inner 1, container according to claim further comprising: an additional replaceable pocket insert containing the bag-shaped inner container at least partially and at least in the storage part.

6. The waste container case and inner container according to claim 5, wherein the pocket insert is closed on the same sides as the insertion wall part of the case.

7. The waste container case and inner container according to claim 1, wherein the interior of the case is coated with a fine fragrance.

8. The waste container case and inner container according to claim 1, further comprising: a retaining device to hold the reception part open in the receptive state of the waste container on the rear wall of the case.

9. The waste container case and inner container according to claim 8, wherein the retaining device is designed as a locating plate engageable with a counterpart.

10. The waste container case and inner container according to claim 1 further comprising: at least one closing tab formed on the insertion wall part engageable with a corresponding slot in the front wall of the case.

11. The waste container case and inner container according to claim 10, wherein at least one closing tab is provided with at least one engagement recess.

12. The waste container case and inner container according to claim 10, wherein at least one closing tab is approximately congruent with the rear wall at least in the storage part.

13. The waste container case and inner container according to claim 1, wherein the insertion wall part is provided with a retaining element to stabilize the case in an angled position in the area of the folding line associated with the transverse closing fold of the inner container.

14. The waste container case and inner container according to claim 13, wherein the retaining element has a tongue, which extends backwards from its edge in the direction of the opening of the inner container and encompasses the rear of the case in the area of the reception part in the angled position of the upper part of the case.

15. The waste container case and inner container according to claim 13, wherein the retaining element is made of a flexible material.

16. The waste container case and inner container according to claim 13, wherein the insertion wall part provided with the retaining element extends at least approximately over the width of the front wall.

17. The waste container case and inner container according to claim 16, wherein a retainer is located in the center of the insertion wall part.

18. The waste container case and inner container according to claim 13, wherein the retaining element has a flexible insert.

19. The waste container case and inner container according to claim 1, wherein the insertion wall part has an integral tab extending beyond the folding line associated with the transverse closing fold and provided with a tongue extending backwards in the case in the direction of the opening of the inner container.

20. The waste container case and inner container according to claim 19, wherein the tongue is located in the center of the insertion wall part.

21. The waste container case and inner container according to claim 1, wherein the rear wall of the case is provided with a retaining element to stabilize the reception part in its angled position relative to the storage part.

22. The waste container case and inner container according to claim 21, wherein the retaining element comprises a tab, the side of which is fixed to the rear wall, while its opposite free side has an insertion element, which can be inserted behind the upper edge of the rear wall to stabilize the reception part.

23. The waste container case and inner container according to claim 1, wherein a receptacle for a cigarette lighter and a cigarette packet are mounted on the insertion wall part.

24. The waste container case and inner container according to claim 1, wherein the front wall is provided with a flap with a closure, the inner container can be folded over above a transverse fold, and wherein the flap is provided with a folding tongue extending backwards from the folding line associated with the transverse closing fold of the inner container in the closed state of the case and overlapping the opening of the inner container.

* * * * *